United States Patent [19]

Schoeps

[11] Patent Number: 4,533,337

[45] Date of Patent: Aug. 6, 1985

[54] HYDRAULIC TORQUE IMPULSE TOOL

[75] Inventor: Knut C. Schoeps, Tyresö, Sweden

[73] Assignee: Atlas Copco Aktiebolag, Nacka, Sweden

[21] Appl. No.: 533,500

[22] Filed: Sep. 19, 1983

[30] Foreign Application Priority Data

Sep. 24, 1982 [SE] Sweden ..... 8205485

[51] Int. Cl.[3] ..... B25D 15/02

[52] U.S. Cl. ..... 464/25; 173/93

[58] Field of Search ..... 464/25, 24; 173/93, 173/93.5, 93.6

[56] References Cited

U.S. PATENT DOCUMENTS

| | | | |
|---|---|---|---|
| 3,072,232 | 1/1963 | Martin et al. | 173/93.5 |
| 3,116,617 | 1/1964 | Skoog | 464/25 |
| 3,221,515 | 12/1965 | Brown | 464/25 |
| 3,263,426 | 8/1966 | Skoog | 464/25 |
| 3,321,043 | 5/1967 | Vaughn | 173/93.5 X |
| 3,561,543 | 2/1971 | Ulbing | 173/93.5 |

*Primary Examiner*—Stephen Marcus
*Assistant Examiner*—Leo J. Peters
*Attorney, Agent, or Firm*—Frishauf, Holtz, Goodman & Woodward

[57] ABSTRACT

In a hydraulic torque impulse tool having a power rotated inertia drive member (10; 110) and a hydraulic fluid chamber (19; 119) a piston (30; 130) is supported in the fluid chamber (19; 119) for reciprocating movement in a plane transverse to the rotation axis of the drive member (10; 110). The piston (30; 130) and the output spindle (11; 111) are provided with cam means (42, 43, 44; 142, 143, 144) by which the piston (30, 130) is reciprocated in the fluid chamber (19; 119) at relative rotation of the drive member (10; 110) and the output spindle (11; 111) of the tool. The piston (30; 130) and the fluid chamber (19; 119) have seal means (31, 28; 131, 128) by which one fluid chamber compartment (38; 138) is sealed off from another (39; 139) during a certain portion of each piston stroke, thereby accomplishing an instantaneous pressure build-up in one of the fluid chamber compartments. The resulting reaction impulse on the piston (30; 130) is transferred to the output spindle (11; 111) via said cam means (42, 43, 44; 142, 143, 144). An adjustable bypass valve (50; 150) is arranged to limit the peak pressure in the fluid chamber (19; 119) as well as the torque impulse magnitude delivered by the tool.

10 Claims, 10 Drawing Figures

HYDRAULIC TORQUE IMPULSE TOOL

BACKGROUND OF THE INVENTION

This invention relates to a hydraulic torque impulse tool primarily intended for applying torque to threaded joint parts, like screws and nuts.

In particular, the invention is related to a torque impulse tool in which the continuous torque output of a rotation motor is converted into torque impulses of a high peak magnitude. An inertia drive member rotatably supported in a housing is drivingly connected to a rotation motor and comprises a fluid chamber into which the rear end of an output spindle extends.

In previous impulse tools of this type, for example the tool described in U.S. Pat. No. 3,116,617, the inertia drive member is formed with a cylindrical fluid chamber which is disposed eccentrically in relation to the rotation axis of the inertia drive member. The rear end portion of the output spindle of this known device carries a radially displaceable blade the purpose of which is to maintain sealing contact with the wall of the eccentric fluid chamber as the inertia drive member is rotated relative to the output spindle. During a short interval of this relative rotation, a seal portion on the spindle, diametrically opposite to the moving blade, comes into sealing cooperation with a seal land on the chamber wall, whereby a rapid pressure build-up occurs on one side of the radial blade and a torque impulse is imposed on the output spindle.

This known type of hydraulic torque impulse tool has never gained any success among the users of torque delivering tools. This is mainly because of its undesirably low power-to-weight ratio.

In order to compensate for a poor impulse generating efficiency, the size of the impulse mechanism has been increased, whereby inevitably the weight and outer dimensions of the tool are increased too. This means that when a tool of the previously known type is adapted to todays performance requirements it would be far too heavy to meet todays demands as regards comfortable tool handling.

The primary object of the invention is to create an improved hydraulic torque impulse tool by which the power-to-weight ratio is substantially increased.

Further advantages and significant features of the invention will be apparent from the following description and drawings.

DETAILED DESCRIPTION

Figure 1:
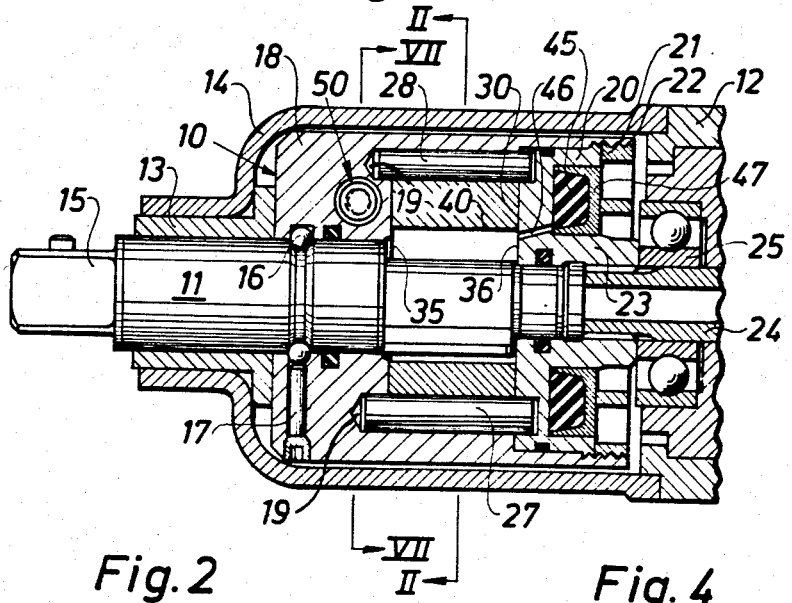
FIG. 1 shows a longitudinal section through a torque impulse mechanism according to the invention.

A complete torque impulse delivering tool according to the invention consists not only of the hydraulic impulse mechanism, embodiments of which are illustrated in the drawing figures, but comprises a tool housing, tool support means, a rotation motor and power supply means. Since these details do not form any part of the invention and are not intimately related to the specific features of the impulse mechanism, the drawings have been limited to show the impulse mechanism only.

The hydraulic impulse mechanism shown in FIGS. 1 to 5 comprises an inertia drive member 10 which is rotatably supported on an output spindle 11 which in turn is rotatably journalled in the tool housing 12. A bearing sleeve 13 mounted in the forward end portion 14 of the tool housing 12 forms the output spindle bearing. At its forward end, the output spindle 11 is formed with a square drive portion 15 on which a nut or screw engaging socket is attachable.

The inertia drive member 10 is axially locked relative to the output spindle 11 by means of steel balls 16 running in circumferential grooves in the spindle 11 and the inertia drive member 10. The balls 16 are inserted through a radial passage and are prevented from falling out that same way by a plug 17.

The inertia drive member 10 is mainly cylindrical in shape and comprises a cup-shaped main body 18 enclosing a concentric hydraulic fluid chamber 19. At its rear end, the fluid chamber 19 is closed by a separate end closure 20 which is locked in position by a ring nut 21 engaging internal threads 22 on the main body 18.

The end closure 20 is formed with a splined socket portion 23 in which the splined shaft 24 of the rotation motor (not shown) of the tool is received. One of the motor shaft bearings 25 serves as a bearing for the inertia member 10 as well.

Within the hydraulic fluid chamber 19, there are mounted two cylindrical pins 27, 28 which are parallel to each other as well as to the rotation axis of the inertia drive member 10. These pins 27, 28 are located diametrically opposite each other and are both partly received in longitudinal grooves in the chamber wall. (See FIGS. 2–5). Both pins 27, 28 also extend into the rear end closure 20, thereby positively locking the latter to the main body 18 as regards rotation.

One of the pins 27 serves as a fulcrum for a pivoting piston 30, whereas the other pin 28 forms a seal and guide means for cooperation with a seal portion 31 and two guide flanges 32, 33 on the piston 30. The piston 30 is formed with flat end surfaces 34, 35 for sealing cooperation with opposite flat end walls 35, 36 of the hydraulic fluid chamber 19. The chamber 19 is divided by the piston 30 into two compartments 38, 39.

The piston 30 is formed with a central opening 40 through which the rear end portion of the output spindle 11 extends. The contour of the edge of this opening 40 forms two sets of cam surfaces which are arranged to engage selectively two separate cam surfaces on the output spindle 11. There are provided two separate sets of cam surfaces on each one of the output spindle 11 and the piston 30 for the purpose of making the tool operable in both directions. However, one set of cam means only on each one of the output spindle 11 and the piston 30 is active to accomplish the intended engagement between the spindle 11 and the piston 30 when rotating the mechanism in one particular direction.

For a normal clockwise direction of rotation of the inertia drive member 10 relative to the output spindle 11 (see arrows in FIGS. 2–5), an abruptly inclined cam surface 42 on the output spindle 11 is engaged alternatingly by a likewise abruptly inclined cam surface 43 and a gradually sloping cam surface 44 on the piston 30. The cam surface inclinations are here related to the directions of the circle tangents in each point of the cam profile.

By interengagement of the cam means on the output spindle 11 and the piston 30, the latter is caused to perform a reciprocating pivoting movement in the fluid chamber 19. A certain stroke length is thereby obtained.

Figure 2:
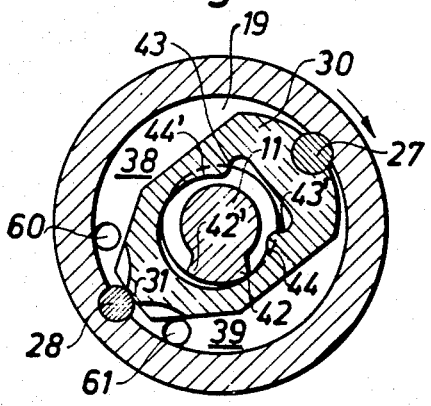
FIGS. 2 to 5 show cross sections taken along line II—II in FIG. 1, which illustrate different sequential positions of the impulse mechanism parts.

For accomplishing a pivoting movement of the piston 30 also when the inertia drive member 10 is rotated in the anti-clockwise direction, another abruptly inclined cam surface 42[1] on the output spindle 11 is engaged alternatingly by an abruptly inclined cam surface 43[1] and a gradually sloping cam surface 44[1] on the piston 30. This is shown in FIG. 2 only. In the shown embodiments of the invention the cooperating cam means are symmetrically designed so as to generate the same piston operation characteristics in both directions of rotation.

For the purpose of absorbing changes in the hydraulic fluid volume due to temperature variations an annular expansion chamber 45 is provided in the rear end closure 20. This expansion chamber 45 communicates with the fluid chamber 19 through a passage 46 and is filled with a foamed plastic material. The foamed plastic material is of the closed cell type and is acted upon directly by the hydraulic fluid. An annular end cover 47 secured in the end closure 20 by the ring nut 21 prevents the plastic material from falling out.

Figure 7:
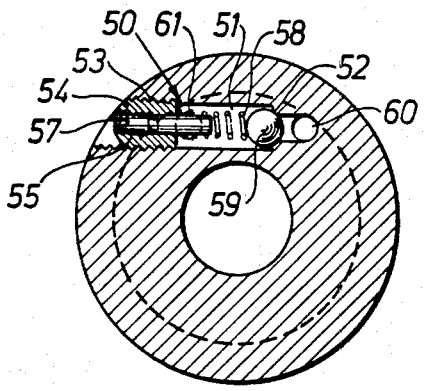
FIG. 7 shows a cross section taken along line VII—VII in FIG. 1.

In the inertia drive member 10 there is provided an output torque limiting device 50. See FIG. 7 in particular. This torque limiting device 50 comprises a bore 51 which is formed with a valve seat 52 at its inner end and having threads 53 at its outer end. Into the outer end of the bore 51 there is threaded a plug 54 which is formed with a threaded coaxial bore 55. A set screw 57 is received in the bore 55 and forms an axial support for a coil spring 58 loading a valve ball 59 against the seat 52.

A passage 60 on one side of the valve 52, 59 communicates with the fluid chamber compartment 38, whereas another passage 61 interconnects the other side of the valve 52, 59 and the chamber compartment 39.

The operation order of the impulse mechanism shown in FIGS. 1 to 7 is described below with reference to FIGS. 2 to 5. The inertia drive member 10 receives rotational power from the motor of the tool via splined shaft 24 and socket portion 23. The inertia member 10 is rotated in a clockwise direction as illustrated by arrows in FIGS. 2 to 5.

To begin with, let us assume that a torque resistance in the screw joint being tightened has already been built up and that the parts of the impulse mechanism occupy the very positions shown in FIG. 2. In this sequence of the operation, the piston 30 is just about to complete its return (or reverse) stroke in a direction from the fluid chamber compartment 38 to the opposite compartment 39. This is accomplished by the cooperation of the cam surface 42 on the output spindle 11 and the gradually sloping cam surface 44 on the piston 30.

During its return stroke, the piston 30 has changed the volumes of the two fluid chamber compartments 38, 39 such that the volume of compartment 38 is increased whereas compartment 39 has become smaller. In the very position shown in FIG. 2, the two compartments 38, 39 are still sealed off relative to each other, since the seal portion 31 of the piston 30 is in contact with pin 28.

During the limited portion of the return stroke when sealing contact between seal portion 31 and pin 28 exists, a certain pressure difference between the two compartments 38,39 arises. Due to the fact, however, that the cam surface 44 on the piston 30 is just gradually sloping inwards and that it is located at a relatively big distance from the fulcrum 27 of the piston 30, the return stroke piston speed is relatively low. This means that the inevitable oil leakage past the piston 30 has a predominant negative effect on the pressure build-up and that no torque impulse generating pressure peak is obtained during the return stroke.

At continued rotation of the inertia drive member 10 and piston 30 relative to the output spindle 11, the abruptly inclined cam surface 43 on the piston 30 gets into contact with the cam surface 42 on the output spindle 11. This position, illustrated in FIG, 3, means the beginning of the impulse generating work stroke of the piston 30. Since the abruptly inclined cam surface 43 of the piston 30 meets the abruptly inclined cam surface 42 on the output spindle 11 and since the contact point of the cam surfaces is relatively close to the piston fulcrum 27 a very fast acceleration of piston 30 is accomplished.

Figure 4:
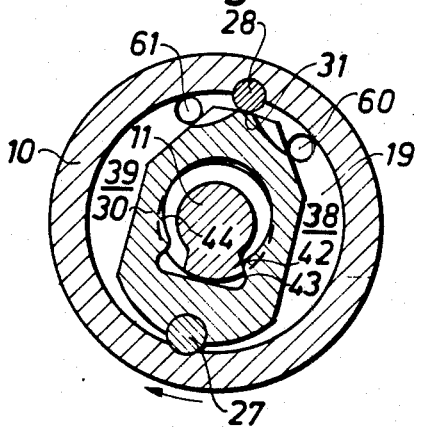
Figure 3:
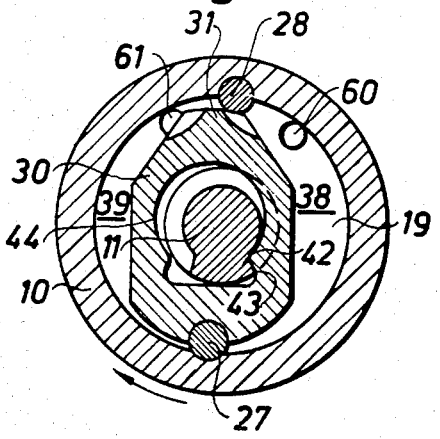
Figure 5:
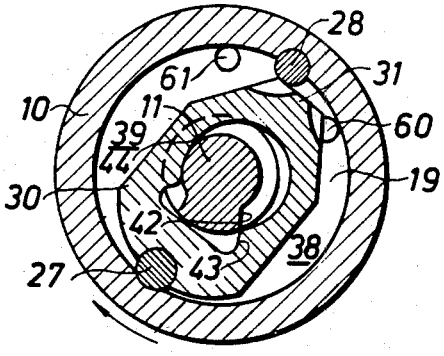
Figure 6:
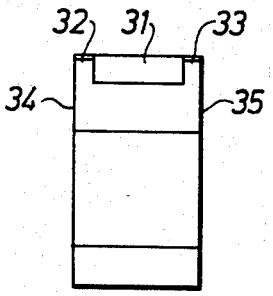
FIG. 6 shows a side view of the piston incorporated in the embodiment shown in FIGS. 1 to 5.

At the very start of the impulse stroke, communication is still maintained between the two fluid chamber compartments 38, 39, because the seal portion 31 of the piston 30 has not yet reached the seal pin 28. See FIG. 3. After a very short time interval, however, the seal portion 31 has established a fluid seal between the compartments 38, 39 by cooperating with seal pin 28. This position is shown in FIG. 4.

Due to the abruptly shaped cam surfaces 43 and 42 and their close location relative to the piston fulcrum 27, the kinetic energy of the rotating inertia drive member 10 is transformed into a pivoting movement of the piston 30 in a very efficient way. However, the piston 30 does never attain any high speed, because an instantaneous back pressure build-up in the right hand fluid chamber compartment 38 occurs. The attained pressure level is very high and corresponds to the kinetic energy of the inertia drive member 10 which is transferred to the piston 30 via the fulcrum pin 27.

The big pressure difference now obtained between the two fluid chamber compartments 38, 39 brings the piston 30 abruptly to a stand still or at least very close to that condition. The result of this heavy, suddenly arisen hydraulic pressure acting on the piston 30 is that all the kinetic energy received from the inertia drive member 10 is transferred onto the output spindle 11 via the cam surfaces 43 and 42. A torque impulse is being delivered to the output spindle 11.

During the impulse generating sequence, the piston 30 moves relatively slowly through an intermediate limited portion of the work stroke. This is when the seal portion 31 is in sealing contact with pin 28. See FIG. 4. After the kinetic energy has been transferred to the output spindle 11 and the rotation speed of the inertia drive member 10 is brought down to approximately nil, the pressure difference across the piston 30 is substantially reduced. Thanks to a certain oil leakage past the piston 30 and due to the continuous action of the torque delivering motor of the tool the piston 30 passes the intermediate sealing interval. Still having its abruptly inclined cam surface 43 in contact with the cam surface 42 on the output spindle 11, the piston 30 is pivoted further to the right such that the sealing contact between seal portion 31 and seal pin 28 is definitely broken. See FIG. 5. Then the oil pressure in the two compartments 38, 39 is equalized.

At continued rotation of the inertia drive member 10 relative to the output spindle 11, the edge of the piston cam surface 43 slips past the outer corner of the output spindle cam surface 42. See FIG. 5. From that on the piston 30 and the inertia drive member 10 are free to rotate for about half a revolution relative to the output spindle 11 without anything happening. When, however, such a 180 degree relative rotation is completed, the gradually sloping cam surface 44 of the piston 30 starts engaging the outer corner of the cam surface 42 on the output spindle 11. At continued relative rotation, another return stroke of the piston 30 is performed. As was described above, the return stroke is comparatively slow and does not give rise to any impulse generating pressure peak.

When tightening a screw joint, a number of torque impulses are delivered from the tool to increase successively the pretension in the screw joint. At the first delivered impulses, the pretension in the joint is still low resulting in a relatively soft reaction and a relatively low pressure peak magnitude in the fluid chamber 19. As the pretension of the screw joint increases, the reaction torque becomes stiffer and causes increasing pressure peak magnitudes in the fluid chamber 19.

At a predetermined pretension level in the screw joint the pressure peaks in the fluid chamber 19 reach a magnitude at which the valve ball 59 is lifted from the seat 52 against the action of the spring 58. Hydraulic fluid is then bypassed from the high pressure chamber compartment 38 to the low pressure compartment 39. Thereby, the output torque of the tool is limited.

Figure 8:
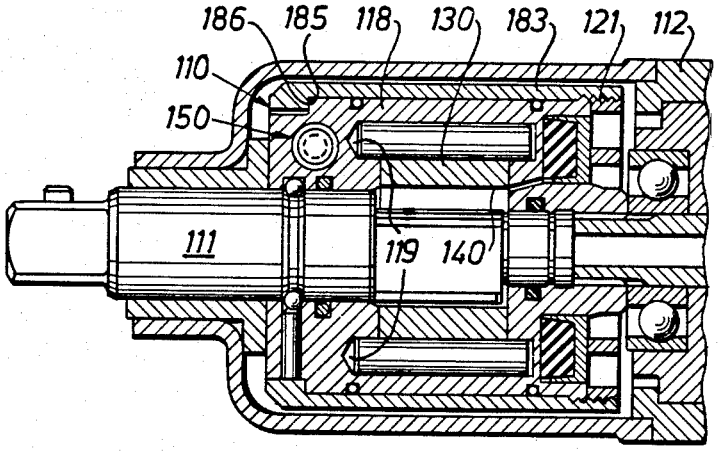
FIG. 8 shows an impulse mechanism according to an alternative embodiment of the invention.
Figure 9:
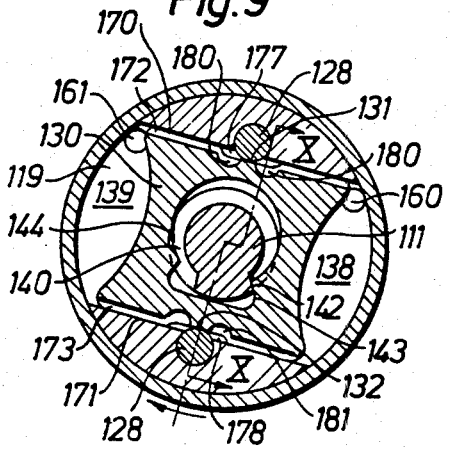
FIG. 9 shows a cross section taken along line IX—IX in FIG. 8.

In the alternative embodiment of the invention illustrated in FIGS. 8 and 9, the inertia drive member 110 is formed with a hydraulic fluid chamber 119 having opposite parallel guide surfaces 170,171 for guiding a reciprocating piston 130 in a translatory path of movement. The piston 130 is provided on each side with two guide ribs 172 and 173, respectively, for cooperation with the guide surfaces 170, 171 in the fluid chamber 119. Two parallel transverse seal pins 127, 128 secured in the inertia drive member 110 are arranged to sealingly engage two opposite flat seal surfaces 131, 132 on the piston 130.

Both of the seal surfaces 131, 132 extend through apertures 177, 178 in the guide ribs 172 and 173, respectively, and reach the side edges of the piston 130. Each of the seal surfaces 131, 132 is defined by two parallel grooves 180 and 181, respectively, which in turn provide for communication between the fluid chamber compartments 138, 139 as the piston 130 occupies either of its end positions.

The fluid chamber 119 is formed by a passage of rectangular cross section which extends transversely through the main body 118. The fluid chamber 119 is further walled in by a cover tube 183 enclosing the inertia drive member main body 118. The cover tube 183 is secured to the main body 118 by a ring nut 121 and by interengagement of two annular shoulders 185, 186 on the main body 118 and the cover tube 183, respectively.

Figure 10:
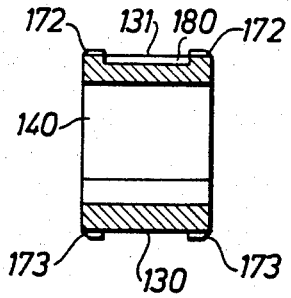
FIG. 10 shows a transverse section through the piston incorporated in the embodiment shown in FIGS. 8–9. The section is taken along line X—X in FIG. 9.

Apart from what has been described above, the embodiment shown in FIGS. 8–10 is identical to the previously described embodiment, and, in order not to make this specification too long we refer back to the above description concerning the previous embodiment. Also the operation order of the later embodiment is identical to that of the previous one, except of course for the movement pattern of the piston.

Instead of being pivoted as a consequence of the camming engagement between the edge surface portions 143, 144 of the central piston opening 140 and the cam means 142 on the output spindle 111, the piston 130 according to the later embodiment is driven forth and back in a translatory movement pattern. As in the previous embodiment the piston 130 performs impulse generating work strokes and oppositely directed return strokes. In both directions, the two fluid chamber compartments 138, 139 which are separated by the piston 130 are sealed off from each other during a short interval of movement. This interval is defined by the extension of the sealing cooperation between the seal pins 127, 128 and the seal surfaces 131, 132 of the piston 130. The high peak pressure difference generated across the piston 130 during the work stroke is effective in transferring the kinetic energy of the inertia drive member 110 to the output spindle 111.

As in the previous embodiment, a valve means 150 is arranged to limit the magnitude of the pressure difference across the piston, thereby also limiting the output torque impulse magnitude of the tool. The adjustable pressure limiting valve 150 is indicated in dotted lines in FIG. 8. In FIG. 9, there are shown passages 160, 161 by which the fluid chamber compartments 138, 139 communicates with the valve 150.

I claim:

1. In a hydraulic torque impulse tool comprising a housing, a rotation motor, an inertia drive member rotatably supported in said housing and drivingly connected to said motor, said inertia drive member being rotatable about a rotation axis, a fluid chamber in said inertia drive member, and an output spindle having a rear end extending into said fluid chamber, the improvement comprising:

a piston (30;130) movably supported in said fluid chamber (19;119) for performing alternate impulse generating strokes and return strokes therein in a plane transverse to the rotation axis of the inertia drive member (10;110), said piston (30;130) dividing said fluid chamber (19;119) into two compartments (38;39;138;139);

a first seal means (31;131) on said piston (30;130);

a second seal means (28;128) on said inertia drive member (10;110) arranged to cooperate with said first seal means (31;131) over only a limited portion of said piston strokes for sealing off one of said compartments from the other;

a first cam means (43,44;143;144) on said piston (30;130); and a second cam means (42;142) on said output spindle (11;111);

said first cam means (43,44;143,144) engaging said second cam means (42;142) to reciprocate said piston (30;130) in said fluid chamber (19;119) and to transfer the torque impulses thereby generated to said output spindle (11;111) during rotation of said inertia drive member (10;110) relative to said output spindle (11;111).

2. Impulse tool according to claim 1, wherein said piston (30;130) comprises an opening (40;140) into which the rear end of said output spindle (11;111) extends, said opening (40;140) having a given edge contour; and said first cam means (43,44;143,144) being formed by the edge contour of said opening (40;140).

3. Impulse tool according to claim 2, wherein said inertia drive member is provided with a pivot means (27) by which said piston (30) is pivotably supported in said fluid chamber (19), said pivot means (27) having an axis which is parallel to the rotation axis of said inertia drive member (10).

4. Impulse tool according to claim 3, wherein said fluid chamber has a wall; said pivot means (27) is located on or close to the wall of said fluid chamber (19); and said second seal means (28) is located diametrically opposite to said pivot means (27).

5. impulse tool according to claim 2, wherein said first cam means (43,44;143,144) comprises an abruptly inclined curve portion (43;143) for engagement with said second cam means (42;142) for causing said torque impulse generating strokes of said piston, and a gradually sloping curve portion (44;144) for engagement with said second cam means (42;142) for causing said return strokes of said piston.

6. Impulse tool according to claim 1, wherein said inertia drive member is provided with a pivot means (27) by which said piston (30) is pivotably supported in said fluid chamber (19), said pivot means (27) having an axis which is parallel to the rotation axis of said inertia drive member (10).

7. Impulse tool according to claim 6, wherein said fluid chamber has a wall; said pivot means (27) is located on or close to the wall of said fluid chamber (19); and said second seal means (28) is located diametrically opposite to said pivot means (27).

8. impulse tool according to claim 1, wherein said first cam means (43,44;143,144) comprises an abruptly inclined curve portion (43;143) for engagement with said second cam means (42;142) for causing said torque impulse generating strokes of said piston, and a gradually sloping curve portion (44;144) for engagement with said second cam means (42,142) for causing said return strokes of said piston.

9. Impulse tool according to claim 8, wherein said inertia drive member is provided with a pivot means (27) by which said piston (30) is pivotably supported in said fluid chamber (19); and said abruptly inclined curve portion (43) of said first cam means is located between said pivot means (27) and the rotation axis of said inertia drive member (10).

10. Impulse tool according to claim 9, wherein said pivot means (27) has an axis which is parallel to the rotation axis of said inertia drive member (10).

* * * * *